US005283923A

United States Patent [19]

Schaedel

[11] Patent Number: 5,283,923

[45] Date of Patent: Feb. 8, 1994

[54] PAINT ROLLER SLEEVE REMOVER

[76] Inventor: Richard Schaedel, 872 Lovell Ave., Mill Valley, Calif. 94941

[21] Appl. No.: 24,392

[22] Filed: Mar. 1, 1993

[51] Int. Cl.[5] ..... B05C 17/02; B05C 21/00

[52] U.S. Cl. ..... 15/230.11; 15/257.01; 7/105; 29/280; 222/327; 222/391

[58] Field of Search ..... 15/230.11, 236.03, 257.01, 15/257.06, 260; 7/105; 29/280; 222/326, 327, 391

[56] References Cited

U.S. PATENT DOCUMENTS

| | | | |
|---|---|---|---|
| 2,783,667 | 3/1957 | Wilson | 29/280 |
| 3,252,210 | 5/1966 | Bowden | 29/280 |
| 3,479,722 | 11/1969 | Maness | 29/280 |
| 3,972,104 | 8/1976 | Partin et al. | 29/280 |
| 4,204,616 | 5/1980 | Chang | 222/391 |

OTHER PUBLICATIONS

"Plastics Technology", Plastics Applications, vol. 7, No. 1, p. 71, Jan. 1961.

*Primary Examiner*—Harvey C. Hornsby
*Assistant Examiner*—Mark Spisich
*Attorney, Agent, or Firm*—Howard Cohen

[57] ABSTRACT

A tool for removing paint saturated roller sleeves from roller frame assemblies includes a ring-shaped front nose piece secured to a skeletal frame which extends to a mechanism having a plunger assembly. The roller sleeve secured to the roller frame is placed in the skeletal frame, which is dimensioned to engage the outer diameter of the roller sleeve. The plunger is advanced toward the nose piece, pushing the roller frame out of the sleeve and releasing the roller frame from the sleeve, which is retained in the skeletal frame. The tool may include a caulking gun-type mechanism for incrementally advancing the plunger, so that a trigger lever may be used to actuate the plunger and remove the roller sleeve. The tool may also be used in conjunction with a cartridge for applying caulking, sealant, glue, and the like.

10 Claims, 3 Drawing Sheets

PAINT ROLLER SLEEVE REMOVER

BACKGROUND OF THE INVENTION

One of the most common means of applying paint is with a paint roller assembly. The roller assembly generally consists of two separate units; a software portion having a cardboard core with polyester or lambs wool attached known as the roller sleeve, and a hardware portion composed of various metal and plastic parts known as the framework assembly. The framework assembly features a handle attached to a long metal shaft which makes several bends before becoming the axle around which a skeletal cylindrical structure rotates. The complete paint roller assembly is put together when the roller sleeve, which is hollow inside, is pushed all the way onto the cylindrical rotating structure. The cylindrical structure consists usually of two plastic end caps at opposite ends held together by several metal rods spaced at regular intervals along the inside perimeters of these end caps. The rods are flexed slightly outwardly in order to supply the necessary friction to keep the roller sleeve from falling off.

This nearly universal system of having the sleeves separate from the framework assembly has evolved because it is usually easier to clean and dry the sleeves when they are separate from the framework, and changing colors and textures is expedited when one can simply take off the used sleeve and replace it with a new one. The main problem with this system is that while it is generally a rather simple matter to slide a dry clean roller sleeve onto a roller frame assembly, the reverse process of removing a slippery paint soaked sleeve from the same assembly can be, and often is, an extremely messy affair. If hands are used to get a grip on the wet sleeve, the hands get totally covered with paint. Plastic disposable gloves can be used to try to escape this difficulty, but these sometimes can fail in supplying sufficient gripping power and also have to be discarded immediately after use. So messy is this problem that it is not uncommon to simply leave the wet sleeves on the frameworks until they dry out, making it even more difficult to eventually try to remove the sleeves. It is probable that every year hundreds of thousands of roller frame assemblies are needlessly tossed into the garbage because their owners were either unable or unwilling to remove the dried-on sleeves.

SUMMARY OF THE PRESENT INVENTION

Accordingly there exists a need for an effective, non-messy system for removing roller sleeves from roller frame assemblies. The present invention addresses this need in a simple, cost effective fashion by using the dispensing action of a caulking gun to push the roller framework out of the roller sleeve. When constructed of sufficiently sturdy materials, my invention is capable of removing sleeves that have been stuck on assemblies for months and even years.

The main advantage of my invention is that the hands are never required to be in contact with the wet, slippery roller sleeve. One hand simply holds onto the handle of the roller frame assembly, inserts it and the roller sleeve into the holder part of my invention while the other hand simply squeezes a trigger until the roller frame assembly pops out, at which point the frame assembly can be laid on a drop cloth to dry. The sleeve is held in place by the plunger rod of the invention until the rod is manually retracted. It can then be dropped into a sink for cleaning, or discarded if the solvent required to clean it is too expensive or too toxic. The skeletal framework employed in the preferred embodiment of the invention has only a few edges which are in contact with the wet paint on the sleeve, and these trap so little paint that the invention can easily be wiped off for re-use.

Another advantage of the invention is that it can accommodate the most popular lengths of roller sleeves—seven and nine inches—and also the most commonly used thicknesses of roller sleeves (called the nap), from enamel type roller sleeves, ⅛ inch thick, to rough texture sleeves more than an inch thick.

While the primary function of the present invention is as a roller sleeve remover, the addition of a simple clip in a preferred embodiment permits it to be used also as a caulking gun. The clip holds the caulk cartridge in place so that the cartridge does not wobble or fall out while the trigger is being squeezed. Since the cartridge is securely clipped to the frame instead of simply being held in place by the size of the plunger as is usually the case in skeleton type caulking guns, the flow of caulk is more controllable and there is less drip when the plunger is released.

These and other objectives and advantages of the present invention will be more readily apparent from the following description and drawings.

DESCRIPTION OF THE PREFERRED EMBODIMENT

Figure 1:
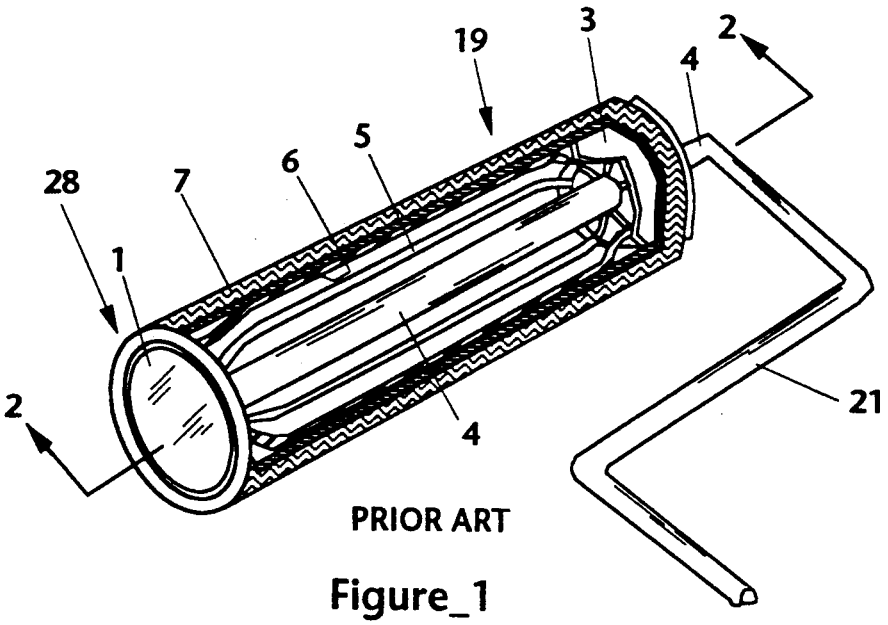
FIG. 1 is a perspective view of a typical prior art paint roller assembly.

With reference to FIG. 1 of the drawings, the reference numeral 28 refers generally to a paint roller assembly which comprises a roller sleeve, generally identified by the reference numeral 19, and a frame generally identified by numeral 21. The roller sleeve member consists of a tubular support 6 and an outer cover or nap 7. The tubular support 6 is held in place by friction against the flexed metal rods 5, which are attached at one end to plastic end cap 1 and at the other end to end cap 3 which has a slight lip 8 extending annularly thereabout. End caps 1 and 3 are attached to a round metal shaft 4 which provides the axis on which these end caps turn, and which makes several right angle bends past end cap 3 until it is finally fixed to the handle 22.

Figure 2:
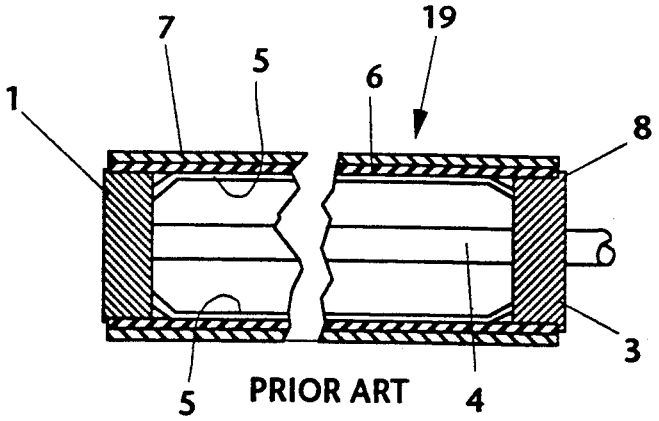
FIG. 2 is a cross-sectional view taken along line 2—2 of FIG. 1.

Referring to FIGS. 1 and 2, the outside diameter of end cap 1 is 1 ½ inches. While the outer diameter of the inner portion of end cap 3 is also 1 ½ inches, the outside diameter of the outer portion or lip 8 is 1 ⅝ inches. This arrangement permits the tubular core 6, which has an inside diameter of 1 ½ inches, to slide snugly over end cap 1, along the metal rods 5, until it butts up against lip 8 of end cap 3. The tight fit keeps paint from entering the interface between the sleeve core 6 and end caps 1 and 3 which would cause drips and lead to unprofessional rolling results; however, this necessary snugness makes the later task of sleeve removal more difficult without the use of the present invention.

Figure 3:
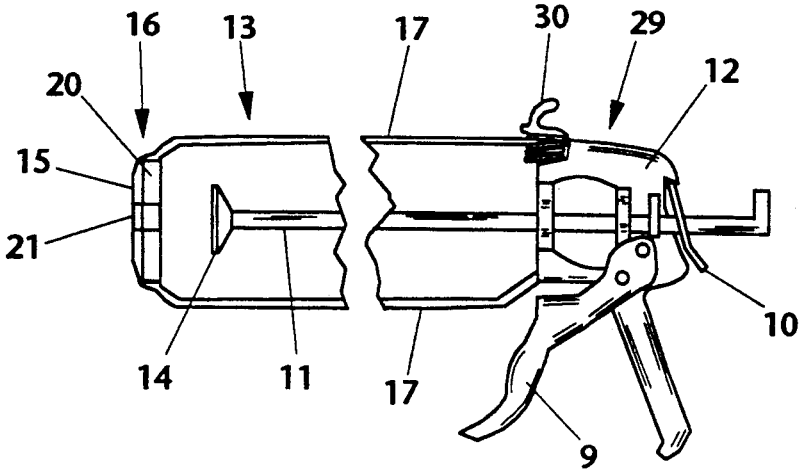
FIG. 3 is a side elevation of one preferred embodiment of the invention.
Figure 4:
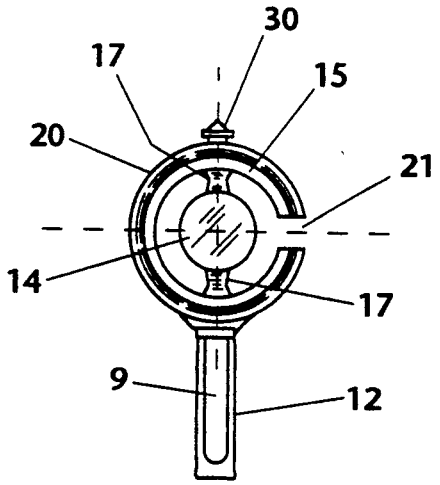
FIG. 4 is an end elevation of the invention viewed from the left hand side as seen in FIG. 3.

The roller sleeve remover which is a preferred embodiment of the present invention is pictured in FIGS. 3 and 4 and identified generally by numeral 29. It is in the general configuration of a skeletal frame type caulking gun, with a mechanism which advances the rod 11 longitudinally when the trigger is squeezed. Any mechanism of this sort can be utilized, although the preferred embodiment features a heavy duty caulking gun having a smooth rod system designed for dispensing mastic and thicker caulks. The plunger 14 which is attached to the front end of the rod 11 is a metal disc which is slightly smaller in diameter than plastic end cap 1 of the roller assembly 28. Since end cap 1 is about 1½ inches in diameter, the preferred disc size would be approximately 1⅜ inches in diameter. Since all caulking guns now on the market feature plungers of larger diameters, the requirement that the plunger be less than 1½ inches in diameter is a distinctive feature of the present invention.

With reference to FIG. 3, the sleeve holder 13 is attached to the stock 12 at one end and to the front, nose shaped portion 16 at the opposite end. The holder comprises two elongate members 17 which in one preferred embodiment are 1/16 inch in thickness and about ¼ to ½ inches in width. The two elongate members 17 should be separated by at least 2¼ inches, and preferably about 2½ inches, to allow for thicker roller sleeves to enter into the sleeve holder. The distance between the stock 12 and the annular nose portion 16 should be at least 9⅛ inches with the preferred distance being about 9⅜ inches.

The top elongate member 17 is welded to the stock 12 at one end, with allowance for a small recess into which the caulking tube spring clip 30 can be pushed when not in use. At its opposite end top elongate member 17 is bent slightly downwards and then bent again to be welded against the top part of ring 20 of nose portion 16. Likewise, the bottom elongate member 17 is welded at one end to stock 12, makes a slight bend downward, then goes straight until it makes a slight bend upward to be welded to the bottom edge of ring 20 of nose portion 16.

Figure 5:
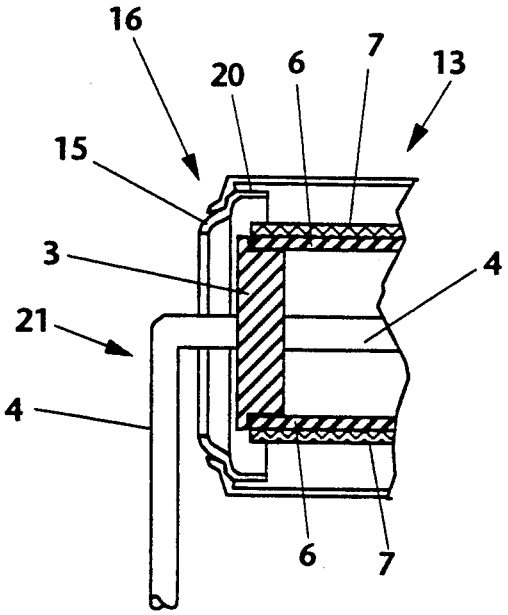
FIG. 5 is an exploded view of the preferred embodiment, illustrating how the paint roller assembly is lined up inside the cartridge holder prior to roller sleeve removal.

The nose portion 16 is of compound design. The inner section of the nose portion 16 is composed of an annular member 20 with an inside diameter of 1⅞ inches and an outside diameter of about 2⅛ inches. with a rim that goes around this member of about ¼ inch in width. The inside perimeter of the member 20 meets the outer perimeter of annular member 15 which curves down to its inside diameter of about 1⅜ inches. This nose portion 16 of the invention should be made of steel or similar high strength material so that the open ring configuration does not distort under stress. With reference to FIGS. 4 and 5, an open notch 21 of more than ¼ inch width splits one side of the nose ring 20 in an area halfway between the attachment points of upper and lower elongate members 17. Skeletal frame caulking guns currently have a ring-shaped front or nose portion with a somewhat similar inside diameter, but none of these has the side notch 21 which allows for passage of the shaft 4 of the paint roller assembly 29.

Figure 6:
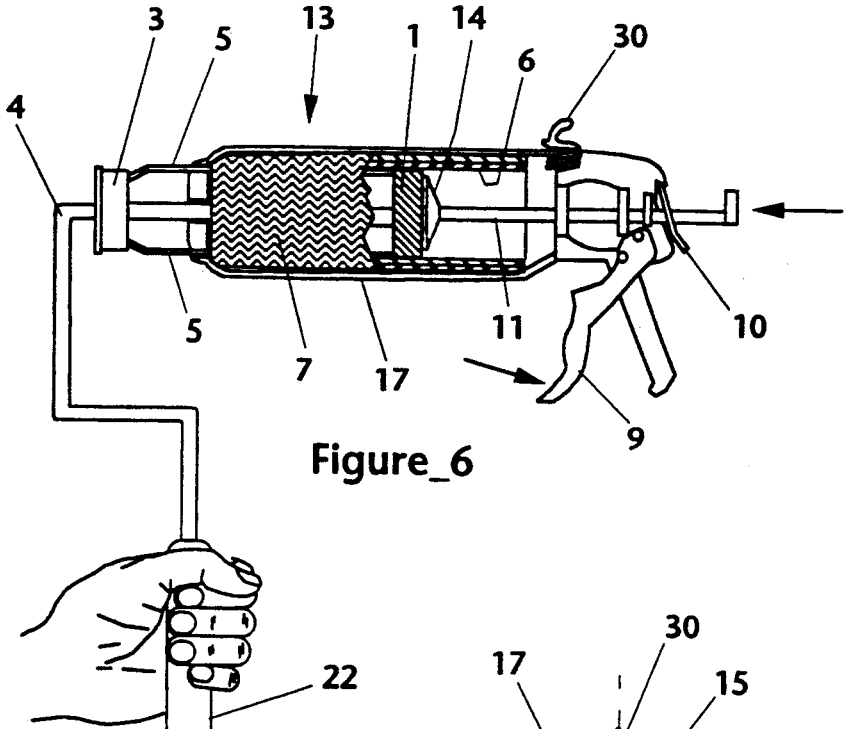
FIG. 6 is a side elevation illustrating how squeezing the trigger of the dispensing mechanism forces the plunger to push out the roller frame assembly while the roller sleeve is restrained inside the cartridge holder of the invention.

FIGS. 5 and 6 show that, in removing the roller frame 21 from inside the roller sleeve 19, the end caps 1 and 3 are lined up inside the sleeve holder 13 between the front nose portion 16 and plunger 14. A small amount of coordination is required to line up plunger 14 so it exactly covers end cap 1 without any overlap onto tubular core 6 of the sleeve 19. Pulling lightly on the shaft 4 adjusts end cap 3 so that it is guided easily into outer annular member 15 of the nose portion 16. Referring to FIG. 6, one hand squeezes the trigger 9, advancing the plunger 14 which pushes on end cap 1 and advances roller frame 21 through the open aperture of nose portion 16. The other hand keeps the roller frame assembly 21 balanced until it is eventually expelled from the roller sleeve 19 which is retained inside the present invention by the inside perimeter of the outer member 15 of nose portion 16. The rod 11 is released either by depressing catch plate 10 or twisting it, depending on the kind of dispensing mechanism used, allowing retraction of plunger 14 and freeing the roller sleeve to be tapped lightly into another receptacle for cleaning or disposal.

Figure 7:
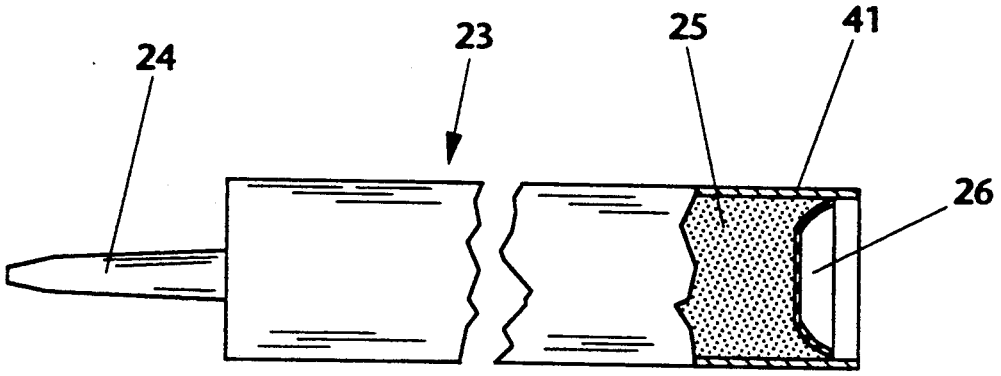
FIG. 7 is a partially cross-sectioned side view of a cartridge of caulking material.

The cartridge shown in FIG. 7 identified by the numeral 23 has a cylindrical body 41 of plastic or cardboard, and typifies prior art cartridge packaging for caulking, adhesive, sealant, and the like. The body is open at one end containing a cup shaped piston 26 which is free to slide along the length of the body. When the nozzle 24 has its tip cut off and the cartridge is punctured, pushing on the piston 26 will cause the caulking material 25 to flow out of the nozzle.

Figure 8:
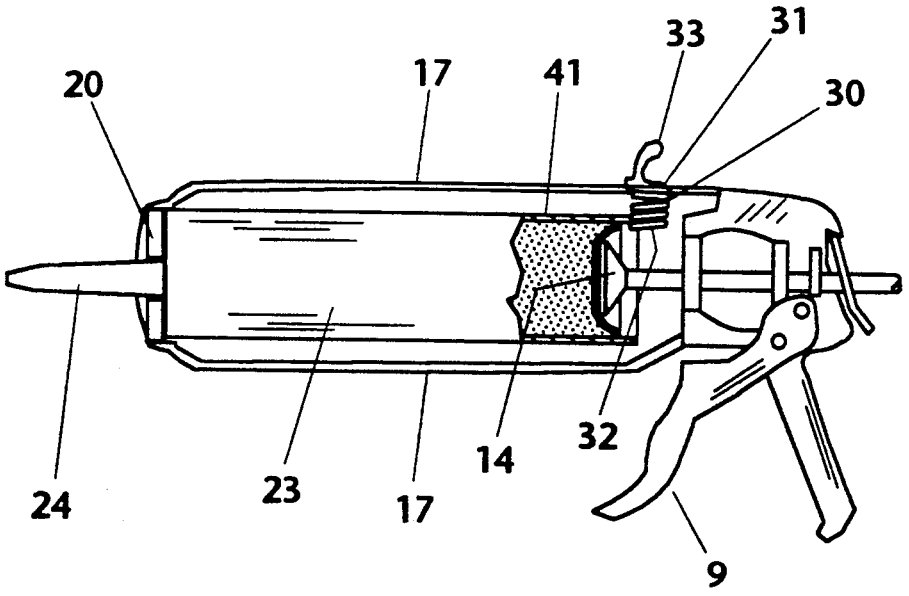
FIG. 8 is a side view showing one embodiment of the invention used as a caulking gun.

FIG. 8 shows how a cartridge is fitted in a preferred embodiment of the present invention 29. The front part of the cartridge body 41 fits into the inner member 20 of nose portion 16. A clip 30 consists of a part which slides on the top elongate member 17 attached to a lower part gripping the back top end of the cartridge body. In one preferred embodiment the clip can be made of three to five coils of key chain wire of about 1¼ inches in diameter. The top winding of this clip 31 slides along the elongate member 17 while the lowest coil 32 can be pushed onto the cartridge back rim. Greater leverage in moving the clip 30 back and forth can be obtained by having a curved projection 33 attached to the top of the clip that can be easily gripped by hand. The clip 30 secures the back end of the cartridge to the member 17 to prevent movement thereof during motion of the plunger to effect dispensing of the caulking material.

Thus the present invention provides a simple mechanism that may be used easily and effectively to remove paint roller sleeves from paint roller assemblies with a minimum of mess and effort. In addition, this mechanism may be used in conjunction with a cartridge to apply caulking, sealant, glue, and the like without any modification.

I claim:

1. In combination with a paint roller assembly including a roller sleeve removably secured to a roller frame having a roller shaft and a handle extending from the shaft, a tool for removing a roller sleeve from a roller frame, including;

a ring-shaped nose piece at a front end of said tool, said nose piece having an end opening dimensioned both to engage an end portion of said roller sleeve and to pass said roller frame therethrough;

a skeletal frame extending from said nose piece toward a rear end of said tool, said skeletal frame dimensioned to accept the roller sleeve;

a plunger supported at said rear end of said tool and operative along a tool axis, said tool axis extending generally colinearly with the center of said ring-shaped nose piece; and means for advancing said plunger along said tool axis toward said front end of said tool to push said roller frame out of said roller sleeve and through and out of said end opening of said nose piece.

2. The tool of claim 1, wherein said nose piece includes a notch extending diametrically therein, said notch disposed to admit the roller shaft of the paint roller assembly into said end opening of said ring-shaped nose piece with said roller shaft extending generally colinearly to said tool axis.

3. The tool of claim 1, wherein said skeletal frame includes upper and lower structural members extending parallel to said tool axis and spaced apart therefrom.

4. The tool of claim 3, wherein said means for advancing includes a rear assembly secured to like rear ends of said upper and lower structural members.

5. The tool of claim 4, wherein said rear assembly includes trigger means for advancing said plunger along said tool axis in incremental fashion.

6. The tool of claim 5, wherein said plunger includes a plunger shaft and a disc-like member secured to a distal end of said plunger shaft.

7. The tool of claim 6, wherein said disc-like member is dimensioned both to engage an end portion of said roller frame and to pass through said roller sleeve.

8. The tool of claim 5, further including means for adapting said tool to engage a cartridge of viscous material and to dispense said viscous material in incremental fashion from a front end of said cartridge.

9. The tool of claim 8, wherein said means for adapting includes clip means for securing a rear end of said cartridge to a rear end of one of said structural members.

10. The tool of claim 9, wherein said plunger is dimensioned to engage a piston disposed in the rear end of said cartridge.

* * * * *